US005088608A

United States Patent [19]

Grum-Schwensen

[11] Patent Number: 5,088,608

[45] Date of Patent: Feb. 18, 1992

[54] LOCKING AND HOLDING DEVICE, PRINCIPALLY FOR HOLDING AND HANDLING OF PATTERN PLATES, CORE MASKS, AND THE LIKE

[75] Inventor: Jens C. Grum-Schwensen, Frederikssund, Denmark

[73] Assignee: Dansk Industri Syndikat A/S, Herlev, Denmark

[21] Appl. No.: 531,708

[22] Filed: Jun. 1, 1990

[30] Foreign Application Priority Data

Jun. 19, 1989 [DK] Denmark ..... 3021/89

[51] Int. Cl.[5] ..... A47F 5/00

[52] U.S. Cl. ..... 211/70.6; 211/1.5; 164/325

[58] Field of Search ..... 29/568; 164/409, 323, 164/324, 325, 326; 211/1.5, 70.6, 163, 165, 110, 205, 13

[56] References Cited

U.S. PATENT DOCUMENTS 4,184,582 1/1980 Borjesson et al. ..... 164/325 X
4,305,692 12/1981 Brauer ..... 164/409 X
4,506,722 3/1985 Yamaguchi et al. ..... 164/325 X
4,590,662 5/1986 Norota ..... 211/1.5 X
4,922,591 5/1990 Campbell ..... 29/568 X

*Primary Examiner*—Robert W. Gibson, Jr.
*Attorney, Agent, or Firm*—Larson and Taylor

[57] ABSTRACT

A locking and holding device holding and handling pattern plates, core masks and similar at molding machines in foundries. The device comprises a base plate (5) with a number of open grooves (6), which have parallel symmetry axes and are adapted to receive complementarily shaped locking studs (13), for example on a pattern plate (9). The base plate (5) is adapted to turn around a central, stationary bushing (8) projecting from the base plate, in which an upwards open recess has been made. The vertical symmetry axis of the recess is parallel to the vertical symmetry axes of the grooves in one turning position of the base plate (5). When the base plate (5) is turned away from this position, the pattern plate (9) cannot be removed from the base plate, because the wall of the recess secures the central stud (14) from the pattern plate.

5 Claims, 2 Drawing Sheets

Figure 1:
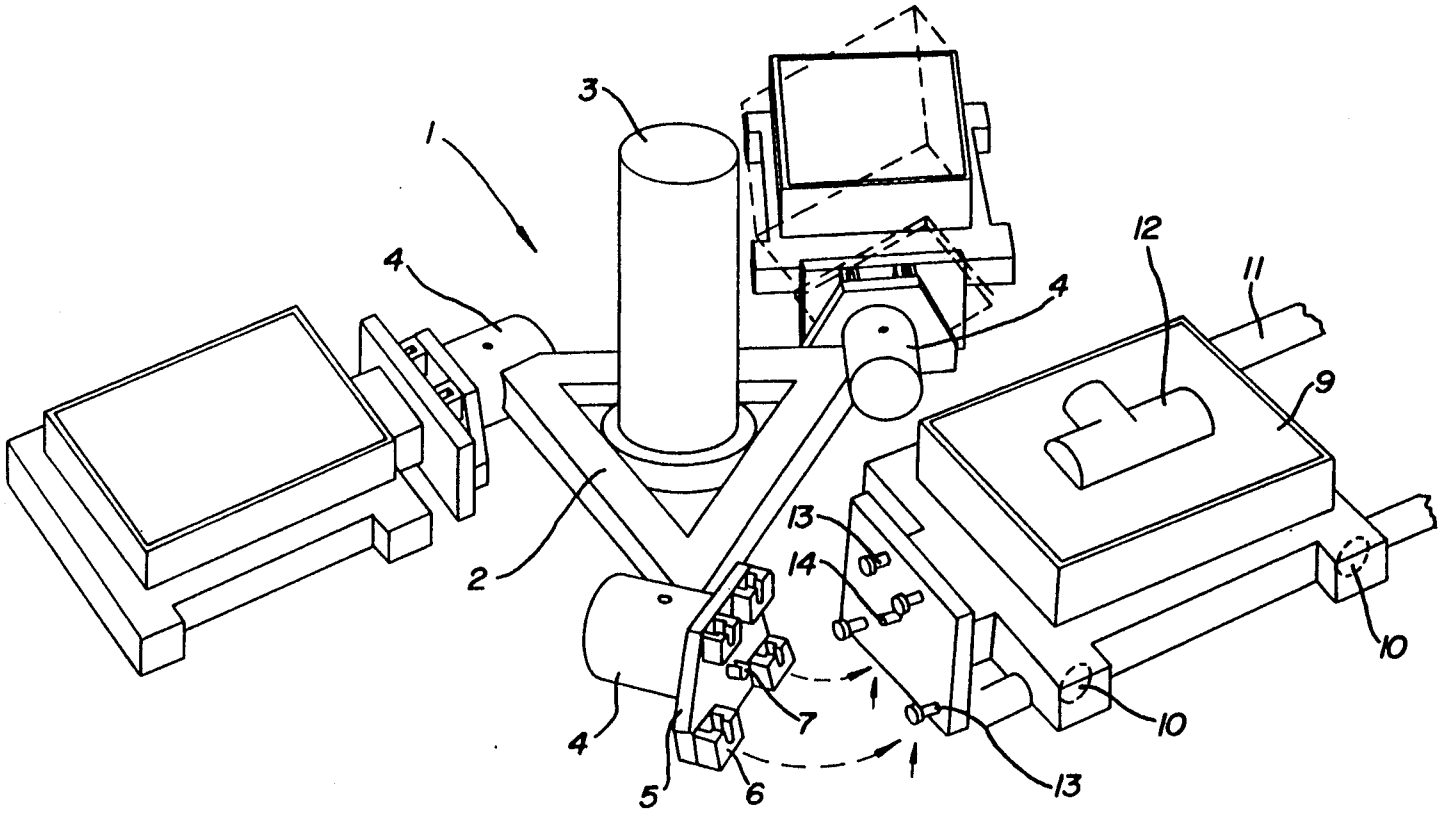

LOCKING AND HOLDING DEVICE, PRINCIPALLY FOR HOLDING AND HANDLING OF PATTERN PLATES, CORE MASKS, AND THE LIKE

The present invention relates to a locking and holding device, principally for holding and handling pattern plates, core masks and the like for molding machines in foundries.

In connection with the production of disposable molds of sand there is a considerable need for being able to handle the comparatively heavy model plates, which are steel plates, on which a pattern is mounted corresponding to for example half the finished casting, in and out of the moulding chamber of the molding machine, which chamber is a closed space, in which molding sand is filled for subsequent compression around the pattern. The handling of the pattern plates outside the mold cavity comprises also conveying the plates to the pattern store. The core masks shall be moved from a position outside the mold cavity in between the mold parts produced in the mold cavity for placing one or several cores in the mold impressions made by the patterns in the molds. I any case it is a question of relatively complicated patterns of movement, combined from swinging or rotary as well as translational movements. The pattern of movement of the pattern plates and the core masks can usually be dissolved into three paths of movement at right angles to each other in combination with a turn around a line in a plane that is parallel to the dividing surface of the mold parts in the mold cavity.

Several examples are known of devices and apparatus for releasable securing of pattern plates and core masks and the handling of same. References can be made to the applicant's own patents (U.S. Pat. No. 4,615,374 and GB-PS 2,164,282) as well as the applicant's own Danish application No. 4897/86.

The known apparatuses are under normal conditions fully capable of holding pattern plates, core masks etc. as well as of handling them in space between a position outside the mold cavity to the requisite position in the mold cavity and to deliver the parts conveyed by automatic release by a locking device. The locking function depends, however, on locking arms transmitting the requisite locking force via hydraulic or pneumatic cylinders, a prerequisite that may fail. A possible failure may cause serious damage to the handling apparatus and the conveyed parts. In addition, the pneumatically or hydraulically transmitted locking forces complicate the handling apparatus and makes it more expensive.

It is the object of the present invention to provide a locking and holding device which on a purely mechanical basis ensures automatic holding of pattern plates, core masks, etc., once these parts have been correctly placed in the locking and holding device. The locking and holding device shall also move the conveyed parts three-dimensionally and allow swinging the pattern plate, core mask etc. around a line parallel with the surfaces of the parts.

This object is achieved according to the present invention with a locking and holding device of the kind referred to initially, and characterised in a) that a base plate has been provided with a number of open grooves, which have parallel running symmetry axes and are adapted to receive complementary shaped locking studs on the part envisaged to be held, b) that the base plate has been adapted to revolve around a central, stationary bushing projecting through the base plate, c) that a recess has been provided in the projecting part of the bushing with a U-shaped cross section in the vertical plane and with an upwards facing opening, whose symmetry axis in the locking/opening position runs parallel to the symmetry axes of the grooves, and d) that on the part envisaged for. holding there are projecting studs adapted to be received in the respective grooves in the base plate, and a central stud, which is adapted to engage in the recess in the projecting, stationary bushing.

When the base plate has been moved to a position vertically under the studs on the part envisaged for being conveyed and with the grooves in the base plate in line with the studs, the junction can be performed by raising the base plate vertically, until the studs rest in the grooves in the base plate and the recess in the central bushing. By shifting the base plate further vertically the conveyed part is raised free of its support and rests solely in the studs. A subsequent turning of the base plate will render removal of the conveyed part impossible, because the symmetry axes of the grooves are no longer parallel to the symmetry axis of the recess. The stud resting in the recess will therefore abutt against the wall of the recess and be locked in the central bushing. In this manner it has been ensured by simple means that the conveyed part can only be placed in the locking and holding device (or be removed from same) when the base plate and the conveyed part and the studs placed on same are in one position and one only in relation to each other. It is therefore possible to place pattern plates and core masks in an oblique position in relation to the horizontal plane, whereby mounting work and maintenance is easier to carry out. The base plate can be suspended in such a manner around the central bushing that a suitable friction is obtained when the pattern plate is turned manually, so that the pattern plate stays immediately in the chosen angular position. Alternatively, it will be possible to adapt controlled turning mechanisms for turning and holding the base plate in position.

At an exemplary embodiment of a locking and holding device according to the present invention the base plate is adapted with a generally T-shaped section in the horizontal plane, where the root of the T meets the surface of the base plate.

In this manner it is ensured in a simple manner that the complementarily shaped locking studs are secured in the base plate even if the locking studs are placed at one end surface of the conveyed part and thereby at a considerable distance from the center of gravity of the part. The bar of the T of the locking studs will abutt against the side surfaces of the T and take up the moment of rotation caused by the center of gravity of the conveyed part.

According to the present invention the stationary bushing can be fastened to a turntable, which may be adapted to turn around a vertical axis and be moved vertically up and down along this axis.

In this manner it is made possible partly to exchange pattern plates or core masks in due time before a pattern exchange in the so-called free positions at the turntable, partly to have the possibility of raising and lowering the base plate with the grooves in and out of engagement with the studs on the part to be conveyed.

According to the present invention a number, preferably three, base plates may be attached to the turntable around bushings that are stationary in relation to the turntable.

In this manner it is achieved that at any time there may be a pattern plate or possibly a core mask in a position, from which by a purely translational movement it is moved in and out of the mold cavity of the molding machine. At the remaining pattern plates there may at the same time be exchanges of pattern plates and or possibly preparatory work such as application of lubricants on the pattern, cleaning of filters in the pattern plate, etc.

Figure 2A:
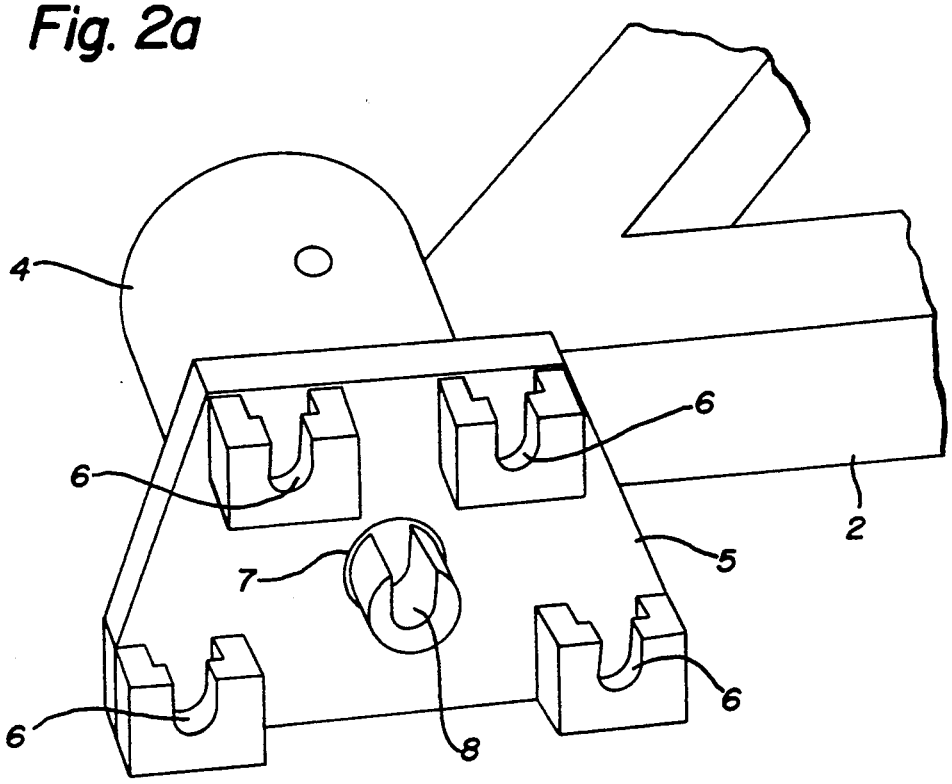
Figure 2B:
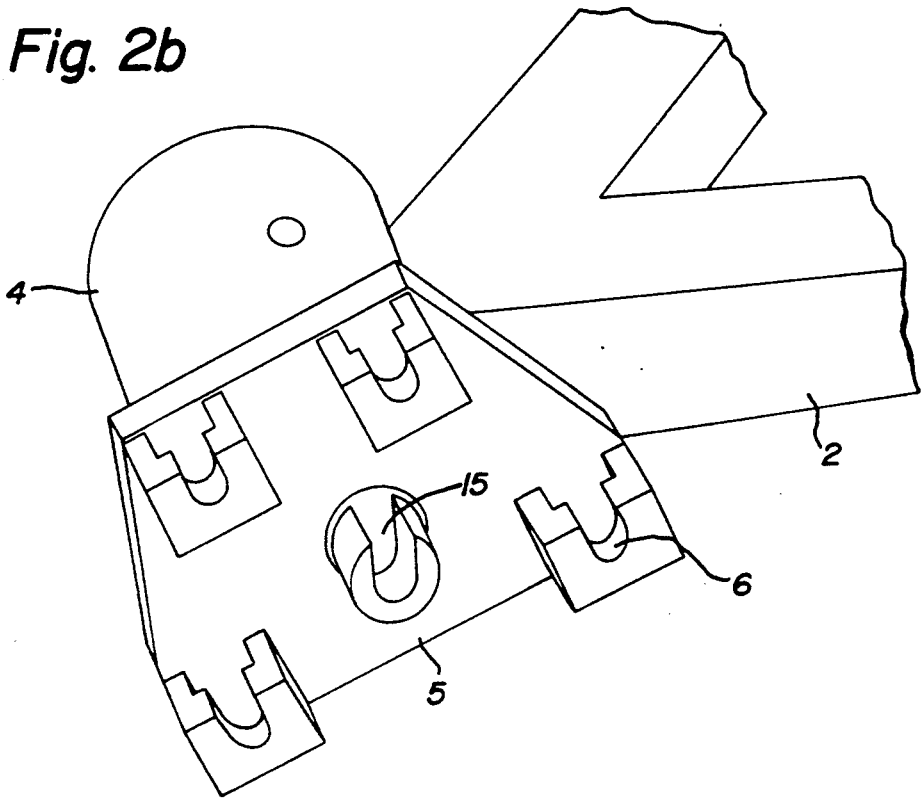

In the following the invention will be explained with reference to the drawing, in which FIG. 1 shows in perspective a changing turret, in which a locking and holding device according to the present invention is used, FIG. 2*a* shows on an enlarged scale the locking and holding device according to the invention, and FIG. 2*b* shows the locking and holding device according to the invention, but with the base plate turned away from the initial position shown in FIG. 2*a*.

The changing turret shown in FIG. 1 is placed next to the mold cavity (not shown) of a molding machine. The changing turret 1 consists of a principally triangular turntable 2, which is mounted in such a manner that it can revolve around a central column 3. The turntable 2 is also adapted to perform an up- and down movement along the column 3. In the exemplary embodiment shown in FIG. 1, bearings 4 are placed at the corners of the turning disk 2. The bearings 4 serve as a hinged mounting of a base plate 5, in which grooves 6 and a central opening 7 have been provided, through which a cylindrical tube section 8 is passed, which is stationary in relation to the turntable 2. In the part of the cylindrical tube section 8 projecting from the base plate 5, a recess 15 has been provided in the upper part. This creates an upward facing, open trough, into which a cylindrical stud 14 can be passed from above with a cross section corresponding to the inside tube diameter.

In FIG. 1 in the lower right corner of the illustration a pattern plate 9 is shown, which at the bottom is provided with wheels 10, running on rails 11. The pattern plate 9 carries a pattern 12. The pattern plate 9 is moved translationally out and in of the mold cavity (not shown) by shifting along the rails 11.

When the pattern plate 9 is in the position shown in FIG. 1, the studs 13,14 projecting from one end of the pattern plate are in a position in which they will be in line with the grooves 6,7 in the base plate 5, when the turntable 2 and the base plate 5 attached to the turntable have been turned to an area under the projecting studs 13,14.

By vertical shifting of the turntable 2 in relation to the pattern plate 9 the studs 13 are moved into the respective groove 6, and the central stud 14 is moved into the trough-shaped opening in the centrally placed, cylindrical tube section 8. By further raising the turntable 2, the pattern plate 9 will hang in the base plate 5 via the studs 13,14, and be lifted free of the rails 11. It will then be possible to turn the pattern plate to arbitrary turning positions around the central column 3, while at the same time turning around the bearing 4, so that the pattern plate can be in an oblique position in relation to the horizontal.

In FIG. 2*a* the base plate 5 is shown on a larger scale. The base plate is oriented in such a manner that the vertical symmetry axes of the grooves 6 shown in the drawing (sketched in dash-and-dot lines) are parallel with the vertical symmetry axis of the cylindrical tube section 8. In addition, the grooves 6 and the cylindrical tube section 8 are placed at generally equal horizontal distances. In this manner the base plate 5 can be moved vertically upwards and in engagement with the similarly adapted and complementarily shaped studs 13 and 14 on one end face of the pattern plate 9.

When the studs 13 and 14 have been received in the respective grooves and openings, the base plate can be turned as described above around the axis of the cylindrical tube section 8. That position is shown in FIG. 2*b*.

In the turning position shown in FIG. 2*b* the pattern plate 9 cannot be removed from the base plate 5, because the symmetry axes of the grooves 6 are no longer parallel with the vertical symmetry axis through the cylindrical tube section 8, which remains stationary.

At the exemplary embodiment shown in the drawing, the studs 13 are provided with an extension at the free end, whereby the studs will be locked in a position abutting against the rear side of groove 6 in the base plate 5, which is T-shaped in horizontal section. In this embodiment the pattern plate 9 is locked in the base plate 5, also in the position in which the pattern plate 9 can be placed in or removed from the base plate 5 (FIG. 2*a*).

The present invention is not limited to just the features shown and specified, and the locking and holding device provided by the invention can therefore also be used in connection with handling of other objects than the pattern plates and core masks set forth above.

I claim:

1. A locking and holding device, suitable for holding and handling a part, such as a pattern plate, core mask or the like, at molding machines in foundries, said device comprising:

a base plate having a plurality of parallel open grooves, a central, stationary bushing projecting through said base plate and having a projecting part with a recess comprising an upward facing opening, and said part to be held having locking studs matched to, and adapted to be received by, said open grooves, a central stud provided on said part to be held which is adapted to engage said recess in said stationary bushing, and wherein said base plate is adapted to rotate on said stationary bushing between unlocked position wherein said open grooves face upwards to receive said part and a locked position wherein said open grooves are rotated to thereby secure said part.

2. The device according to claim 1, wherein the grooves in the base plate have a generally T-shaped cross section in a horizontal plane with a narrow portion of the T-shaped groove extending to the surface of the base plate.

3. The device according to claim 1, wherein the stationary bushing is fastened to a turntable, which is adapted to rotate on a vertical axis and move vertically up and down along said vertical axis.

4. The device according to claim 3, wherein a plurality of said bushings are fastened to said turntable each carrying a said base plate.

5. The device according to claim 4, having three of said bushings fastened to said turntable.

* * * * *